United States Patent [19]

Steiniger

[11] 4,373,538

[45] Feb. 15, 1983

[54] METHOD AND APPARATUS FOR FORMING A STREAM FROM SEVERAL TYPES OF TOBACCO

[75] Inventor: Wolfgang Steiniger, Börnsen, Fed. Rep. of Germany

[73] Assignee: Hauni-Werke Körber & Co. KG., Hamburg, Fed. Rep. of Germany

[21] Appl. No.: 234,454

[22] Filed: Feb. 17, 1981

[51] Int. Cl.[3] ..... A24C 5/39; A24C 5/14

[52] U.S. Cl. ..... 131/109 R; 131/108; 131/109 B

[58] Field of Search ..... 131/84 R, 109 R, 84 C, 131/108, 109 B, 109 AB, 110, 280

[56] References Cited

U.S. PATENT DOCUMENTS 4,185,644 1/1980 Heitmann et al. ..... 131/109 R 4,233,685 9/1980 Labbe ..... 131/109 R

*Primary Examiner*—V. Millin

*Attorney, Agent, or Firm*—Kontler, Grimes & Battersby

[57] ABSTRACT

A tobacco stream which contains shreds and short tobacco is formed by moving an endless elevator conveyor with equidistant comb-like vanes first past a first magazine which contains short tobacco whereby the slender triangular prongs of the vanes remove and entrain batches of short tobacco and thereupon past a second magazine which contains shreds whereby the prongs of the vanes augment each batch by adding thereto an oversupply of tobacco shreds. A first paddle wheel with comb-like blades is adjacent to the path of the vanes to remove the surplus from successive batches, and a second paddle wheel serves to remove the surplus of shreds from augmented batches. Such batches are then converted into the stream which is trimmed by one or more knives which form short tobacco. The thus obtained short tobacco is fed to the first magazine.

23 Claims, 2 Drawing Figures

METHOD AND APPARATUS FOR FORMING A STREAM FROM SEVERAL TYPES OF TOBACCO

BACKGROUND OF THE INVENTION

The present invention relates to a method and apparatus for treating tobacco, and more particularly to a method and apparatus for converting particles or fragments of tobacco into a continuous tobacco stream, for example, into a stream which is ready for trimming and conversion into a wrapped cigarette rod. Still more particularly, the invention relates to improvements in a method and apparatus for building a tobacco stream from a plurality of different types of tobacco, particularly from tobacco shreds and so-called short tobacco. The term "short tobacco" is intended to embrace tobacco dust as well as fragments which are removed from an unequalized tobacco stream by a cutting action during conversion of such stream into a trimmed stream or filler which is ready for wrapping into cigarette paper, imitation cork or other suitable wrapping material.

It is already known to build a tobacco stream from freshly supplied tobacco shreds which are withdrawn from a first magazine and are mixed with short tobacco, i.e., with tobacco which is removed from an unequalized stream by trimming and is returned to the distributor of the stream forming machine, e.g., of a cigarette maker. It is also known to place the magazine for accumulated short tobacco upstream of the magazine for freshly supplied tobacco shreds and to employ a suitable conveyor which is provided with spaced-apart entraining elements in the form of vanes or blades capable of removing batches of short tobacco from the upstream magazine and thereupon tobacco shreds from the downstream magazine. Reference may be had to commonly owned U.S. Pat. No. 4,185,644 granted Jan. 29, 1980 to Heitmann et al. The conveyor of Heitmann et al. is an endless elevator having an elongated upwardly moving stretch whose vanes move first past the upstream magazine for short tobacco and thereupon past the downstream magazine for fresh tobacco shreds. A paddle wheel equalizes the accumulated tobacco batches, each of which contains short tobacco as well as tobacco shreds, before the batches are dumped into an upright duct for conversion into a continuous stream which contains a surplus of tobacco. The stream is then trimmed by removing the surplus therefrom whereby the removed surplus constitutes or forms part of short tobacco. A suitable conveyor system, e.g., a pneumatic conveyor or a combination of pneumatic and mechanical conveyors, is utilized to transport short tobacco from the trimming station to the magazine which is adjacent to the upwardly moving reach of the aforementioned endless elevator. As a rule, the magazine which serves for storage of freshly supplied tobacco shreds also contains some particles of stem, ribs, birds' eyes and like relatively hard and often bulky fragments of tobacco which should be segregated from other particles prior to the trimming and wrapping steps. To this end, the duct which receives batches of tobacco from the vanes of the endless elevator is normally followed by a classifying unit which segregates particles of ribs, stem and the like from satisfactory particles before the satisfactory particles are converted into a stream which is advanced toward and past the trimming device or devices. The quality of the distributor (i.e., of that part of a cigarette making or an analogous machine which delivers tobacco particles to the stream forming or stream building station) greatly affects the quality of the ultimate product. Thus, a satisfactory distributor must form a uniform or nearly uniform tobacco stream with a minimum of short tobacco because the latter is inferior to freshly supplied tobacco shreds and is reprocessed primarily because of the high cost of tobacco, i.e., the manufacturers of cigarettes strive to use up all or nearly all parts of tobacco leaves including laminae as well as ribs, stem and relatively small fragments (short tobacco) which necessarily develop in the course of processing (especially trimming) in a cigarette making machine. Furthermore, the quality of cigarettes is more satisfactory if the percentage of short tobacco in each of a long series of cigarettes is uniform, i.e., if the quantity of short tobacco does not fluctuate extensively from cigarette to cigarette or from cigarette pack to cigarette pack.

Commonly owned German Offenlegungsschrift No. 27 29 730 discloses a distributor wherein short tobacco which develops as a result of trimming a continuous tobacco stream is reprocessed without delay and without permitting such tobacco to mix with freshly supplied tobacco shreds. Moreover, such short tobacco is prevented from accumulating into a large mass prior to reintroduction into the stream building zone. It has been found that such distributors are quite satisfactory in many respects with the important exception that the quantity or percentage of short tobacco is likely to vary from cigarette to cigarette or from a relatively short first series to the next-following series of cigarettes.

OBJECTS AND SUMMARY OF THE INVENTION

An object of the present invention is to provide a novel and improved method of reusing short tobacco in a cigarette making or analogous machine in such a way that the percentage of short tobacco can be maintained at a constant value or can be varied only when the person in charge so desires.

Another object of the invention is to provide a novel and improved method of making a continuous tobacco rod by resorting to plural tobacco types and of ensuring that each and every unit length of the rod contains a predetermined percentage of each tobacco type.

A further object of the invention is to provide a novel and improved method of immediately reprocessing short tobacco which is obtained as a result of removal of the surplus of a freshly formed tobacco stream in a cigarette maker or a like machine.

An additional object of the invention is to provide a method of the just outlined character which allows for convenient and accurate adjustment of the percentage of short tobacco in the stream which is about to be converted into the filler of a cigarette rod or the like.

A further object of the invention is to provide a novel and improved apparatus for the practice of the above outlined method.

An additional object of the invention is to provide a novel and improved distributor for use in cigarette making and like machines.

Another object of the invention is to provide the distributor with novel and improved means for ensuring the formation of a continuous tobacco stream which contains predetermined percentages of two or more different tobacco types, particularly freshly supplied tobacco shreds and short tobacco.

An additional object of the invention is to provide the distributor with novel and improved means for rapidly and accurately changing the percentage of one or more types of tobacco in the stream.

One feature of the invention resides in the provision of a method of forming a tobacco stream which contains predetermined percentages of plural types of tobacco, especially freshly supplied tobacco shreds and short tobacco. The method comprises the steps of establishing and maintaining discrete first and second sources of first and second tobacco types, withdrawing from the first source (e.g., from the source which contains short tobacco) a succession of discrete batches at least some of which contain a surplus of tobacco of the first type (i.e., more than would be required to maintain the preselected percentage of such tobacco in the stream), removing the surplus from the respective batches so that, upon completion of the removing step, each of the batches at most contains a predetermined maximum acceptable quantity of tobacco of the first type, transporting successive batches (namely, those batches which do not contain more than the predetermined quantity of tobacco of the first type) past the second source, augmenting successive batches by adding to each batch tobacco of the second type during transport of successive batches past the second source, and converting the augmented batches into the stream.

The removing step preferably includes segregating the surplus from successive batches which contain a surplus of tobacco of the first type by resorting to a combing action.

The augmenting step preferably includes adding a surplus of tobacco of the second type to at least some of the batches, and the method then preferably further comprises the step of equalizing the augmented batches prior to the converting step. Such equalizing step includes segregating surplus tobacco of the second type from the respective augmented batches so that each batch which advances beyond the equalizing or segregating station contains an accurately determined quantity of tobacco of the first type as well as an accurately determined quantity of tobacco of the second type. Such batches can be readily converted into a stream wherein each unit length contains a preselected percentage of tobacco of the first type as well as a preselected percentage of tobacco of the second type.

The method preferably further includes the steps of establishing an elongated path which extends past and beyond the first and second sources and advancing a plurality of equidistant pockets (such pockets can be defined by an endless conveyor band or belt and by vanes or blades which are attached to and extend from the outer side of the endless belt or band) along the path. The withdrawing step of forming the batches then includes at least partially filling the pockets during advancement of the pockets past the first source and the removing step includes expelling tobacco of the first type from successive pockets in a portion of the path which is disposed between the first and second sources. The augmenting step then includes overfilling (all or certain) successive pockets during advancement of pockets past the second source, and the equalizing or segregating step may comprise removing from successive pockets any tobacco of the second type which extends from overfilled pockets. The path preferably slopes upwardly in a direction from the first source toward, past and beyond the second source.

It is further preferred to maintain the quantity of tobacco in at least one of the sources at a substantially constant value. This facilitates orderly removal of preselected quantities of tobacco from the respective source, i.e., the formation of batches which necessitate a minimum of equalizing or surplus-removing action.

As mentioned above, at least the major part of at least one source (preferably the first source) consists of tobacco shorts or short tobacco. As further mentioned above, short tobacco can be obtained (and is normally obtained) by trimming the stream. The trimmed-off surplus is delivered to the first source to form an accumulation of tobacco of the first type.

Each of the withdrawing and augmenting steps may include combing the mass of tobacco in the respective source to respectively remove batches from the first source and to add tobacco of the second type to successive batches during transport of such batches past the second source.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
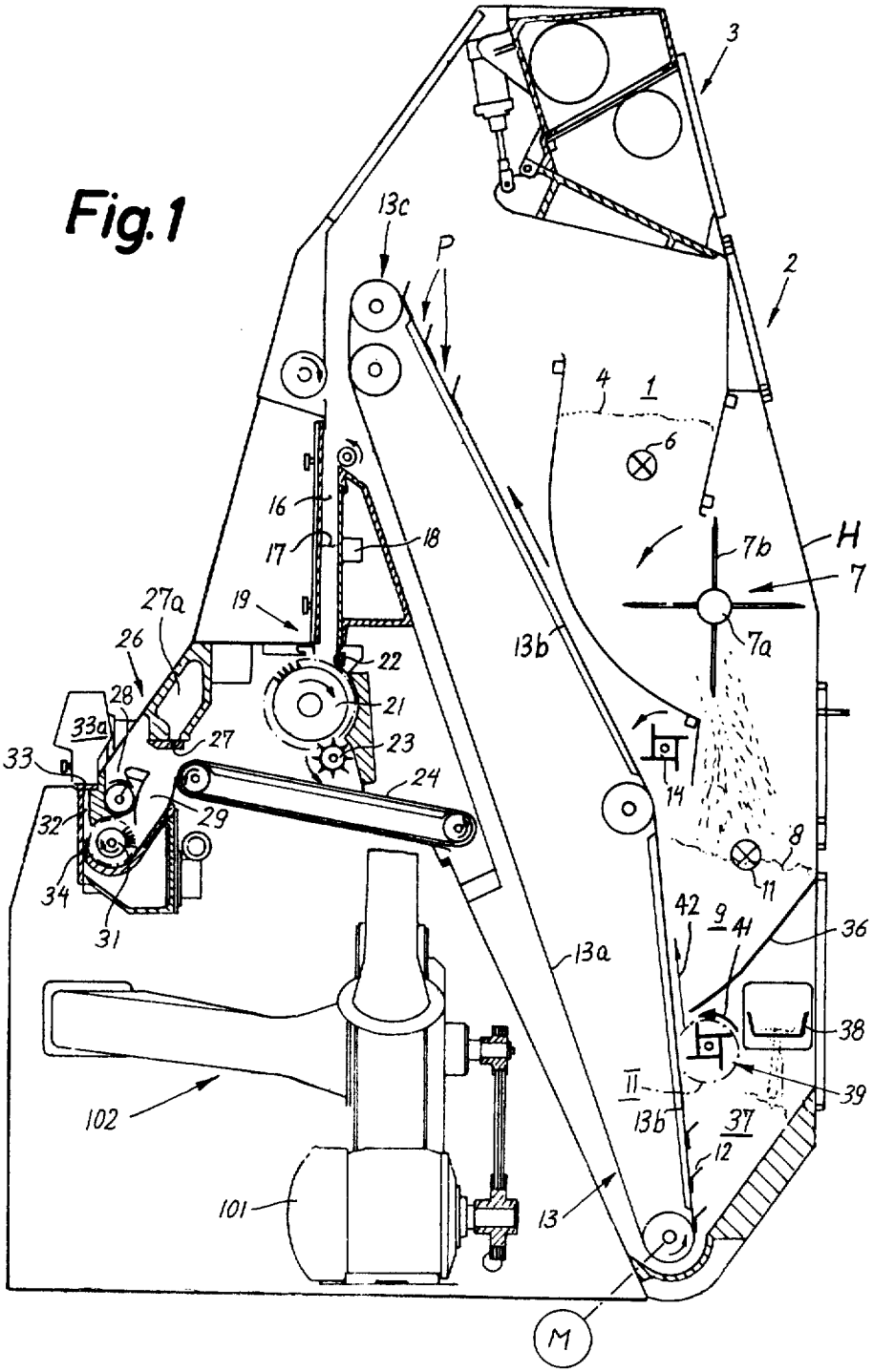
FIG. 1 is a somewhat schematic longitudinal vertical sectional view of an apparatus which embodies the invention.

FIG. 1 shows a portion of a cigarette making machine having a distributor 2 which includes a hopper 1 for a supply 4 of fresh tobacco. The hopper 1 intermittently receives supplies of fresh tobacco by way of a gate 3 which opens in response to signals transmitted by the transducer of a photocell 6. The photocell 6 is installed in or on the housing H of the magazine 1 and its transducer generates a signal for opening of the gate 3 when the light beam issuing from the light source of the photocell 6 can reach the photosensitive surface of the transducer, i.e., when the photocell 6 is exposed. Such arrangement ensures that the supply of fresh tobacco in the hopper 1 is at least substantially constant. The photocell 6 can be said to constitute a level monitoring device or detector which initiates intermittent admission of fresh tobacco shreds but is likely to contain some fragments of ribs, stem, birds' eyes and like undesirable components which, as a rule, are segregated from the shreds prior to the formation of a continuous tobacco stream.

The hopper 1 constitutes a main source of supply of fresh tobacco for a magazine 9 which is mounted in the housing H at a level below the hopper 1 and receives fresh tobacco from the hopper 1 in response to rotation of a transfer conveyor 7 having a shaft 7*a* journalled in the housing H and radially extending paddles or blades 7*b* which effect the transfer of fresh tobacco into the magazine 9. The supply of fresh tobacco in the magazine 9 is indicated by the reference character 8. The motor (not shown) which drives the shaft 7*a* of the transfer conveyor 7 is set in motion in response to signals generated by the transducer of a second photocell 11 which is installed in or on the housing H and monitors the level of the upper surface of the supply 8. The photocell 11 ensures that the quantity of fresh tobacco in the magazine 9 is at least substantially constant. This contributes to the formation of a tobacco stream wherein the percentage of fresh tobacco is more likely to be maintained within a desirable or optimum range.

The distributor 2 further comprises an elevator conveyor 13 including an endless flexible element in the form of a belt or band 13*a* and several equidistant entraining elements in the form of comb-like vanes or blades 12 extending at an acute angle to the outer side of the belt 13*a* and defining therewith a series of equidistant pockets P. That reach (denoted by the character 13*b*) of the endless belt 13*a* which travels upwardly toward, past and beyond the magazine 9 defines an elongated path a portion of which is adjacent to the open side of the magazine 9 and a preceding portion of which is adjacent to a further magazine 37 constituting a source of supply of a second type of tobacco, namely, short tobacco which is obtained in response to trimming of the surplus off a continuous tobacco stream formed in the leftmost portion of the apparatus shown in FIG. 1.

The blades 12 which move upwardly with the ascending reach 13*b* of the belt 13*a* remove small portions or batches of fresh tobacco from the magazine 9 (i.e., from the supply 8 in the magazine 9) whenever the elevator 13 is in motion. Such batches or portions are equalized by a rotating paddle wheel 14 or an analogous equalizing device which is preferably of the type that does not cause any comminution of particles or fragments which form the supply 8. The equalizing device or paddle wheel 14 ensures that each and every pocket P which advances upwardly and beyond the magazine 9 does not contain more than a predetermined maximum quantity of tobacco particles. Its positioning is preferably such that it removes tobacco particles which overflow or extend from the neighboring pockets P so that the extent to which each pocket advancing toward the upper end turn 13*c* of the elevator 13 is filled with tobacco is the same or nearly the same.

A pocket P which reaches the end turn 13*c* drops the equalized quantity of tobacco into an upright duct 16 so that the latter accumulates a supply or pile 17. The height of such pile is monitored by one or more photoelectric detectors 18 which generate signals serving to control the speed of the motor M which drives the elevator 13. This ensures that the height of the pile 17 is at least substantially constant or that such height fluctuates within a relatively narrow range when the apparatus of FIG. 1 is in actual use. The lower end portion or outlet 19 of the duct 16 is located above the path of the carding on a rotary drum-shaped removing conveyor 21 which is driven to rotate in a clockwise direction, as viewed in FIG. 1, and to advance a layer of tobacco particles past an oscillating homogenizing bar 22 of the type disclosed in commonly owned U.S. Pat. Nos. 3,996,943 and 3,996,944 granted Dec. 14, 1976 to Alfred Hinzmann. The purpose of the homogenizing bar 22 is to ensure that the spaces between the projections constituting the carding of the removing conveyor 21 are uniformly filled with particles of tobacco. Moreover, the bar 22 maintains the lower end portion of the pile 17 in the duct 16 in motion so that the material of the pile 17 is not likely to bridge in the region of transfer of tobacco into the range of the carding on the removing conveyor 21. The latter is driven by the motor 101 of a fan 102 in a manner as disclosed in the aforementioned commonly owned U.S. Pat. No. 4,185,644 granted Jan. 29, 1980 to Heitmann et al. The disclosure of this patent is incorporated herein by reference.

The removing conveyor 21 cooperates with a rapidly rotating picker roller 23 which expels the particles of tobacco from the carding and causes such particles to descend onto the upper reach of an endless apron conveyor 24 which is driven to move its upper reach in a direction to the left, as viewed in FIG. 1. The upper reach of the conveyor 24 accumulates a uniform carpet or sliver of tobacco particles and the leading edge or leader of such carpet is propelled beyond the left-hand end turn of the conveyor 24 into a classifying unit 26 wherein the heavier particles of tobacco are segregated from lighter particles. A plenum chamber 27*a* of the classifying unit 26 discharges streamlets or currents of compressed air downwardly through a row of orifices 27 so that the currents of air form a curtain which is traversed by the heavier particles (ribs, stem and birds' eyes) whose inertia is relatively high. The lighter particles including shreds and short tobacco are deflected into a hopper 29 and the heavier particles accumulate in a trough 28 to be evacuated, either continuously or at regular or irregular intervals, by a feed screw or the like (not shown). The speed of the conveyor 24 is selected in such a way that the classifying unit 26 can effect a highly reliable segregation of heavier particles from the more satisfactory particles (shreds) as well as from short tobacco. The opening at the lower end of the hopper 29 receives a portion of a carded drum-shaped conveyor 31 which transfers the lighter fraction of the material delivered by the apron conveyor 24 into a tobacco channel 32 below the lower reach of an elongated belt conveyor 33 which accumulates a continuous tobacco stream ready to be trimmed and thus converted into a tobacco filler. The filler is thereupon draped into a web of cigarette paper or the like to form a continuous cigarette rod. The rod is severed at regular intervals to yield a succession or file of discrete plain cigarettes of unit length or multiple unit length. The means for promoting upward movement of particles of tobacco in the channel 32 (i.e., toward the underside of the lower reach of the conveyor 33) includes a plurality of nozzles 34 which discharge compressed air in an upward direction, as viewed in FIG. 1. The lower reach of the conveyor 33 (which is foraminous) travels below the open underside of a suction chamber 33*a* which attracts the particles of tobacco to the conveyor 33 so that the latter can build a continuous stream consisting of tobacco shreds and short tobacco.

The manner in which the structure in the left-hand portion of FIG. 1 forms a tobacco stream which is then trimmed and wrapped is disclosed in the aforementioned commonly owned U.S. Pat. No. 4,185,644 to Heitmann et al. This patent also discloses one mode of gathering short tobacco which is formed in response to trimming of the stream at the underside of the conveyor 33 and of returning the thus accumulated short tobacco to the distributor 2 for renewed introduction into the duct 16 and thence into the channel 32.

The magazines 37 and 9 (i.e., the sources of first and second types of tobacco) are separated from each other by a sheet metal panel 36 which constitutes the bottom wall of the magazine 9. The conveyor 38 in the lower right-hand portion of FIG. 1 forms part of the means for transporting short tobacco from the trimming device below the lower reach of the conveyor 33 into the magazine 37. The trimming device is shown in FIG. 5 of the aforementioned patent to Heitmann et al.

Figure 2:
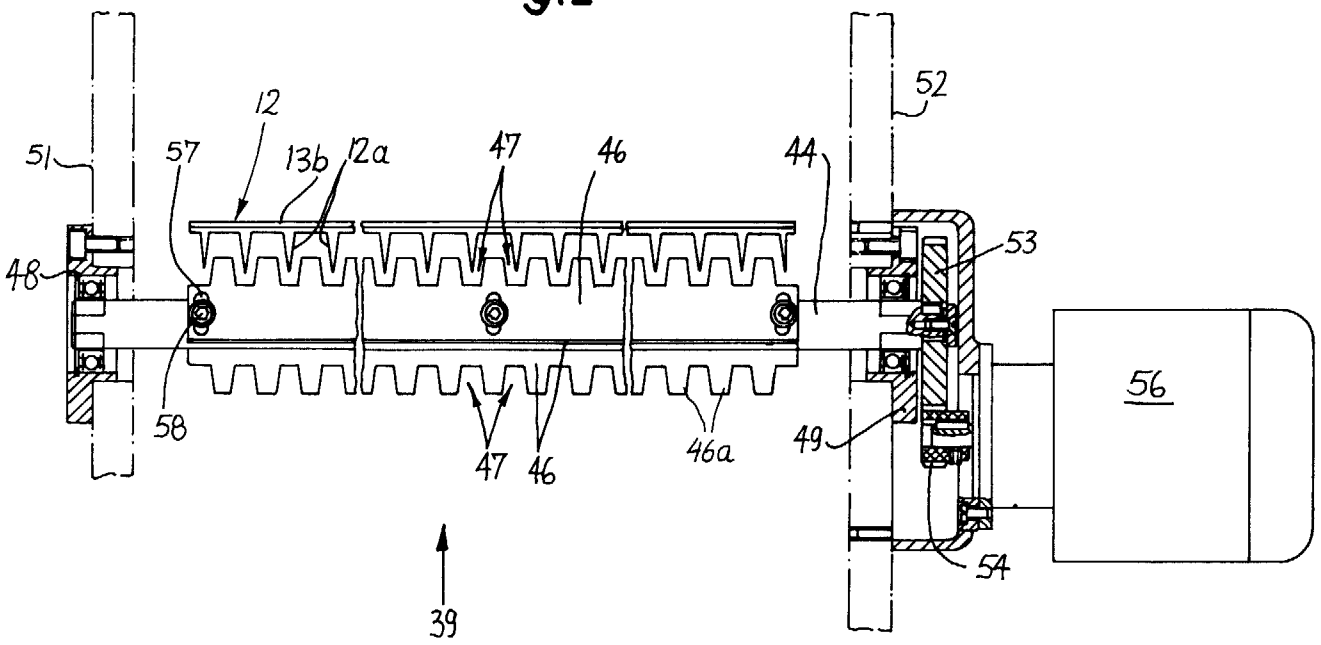
FIG. 2 is an enlarged transverse sectional view of that portion of the apparatus which is located within the broken-line circle II shown in FIG. 1.

In accordance with a feature of the present invention, the housing H of the distributor 2 further contains a surplus removing device 39 which is installed in the magazine 37 adjacent to the path of the ascending reach 13*b* of the belt 13*a* and serves to equalize the batches of short tobacco which are withdrawn by successive pockets P while the pockets advance past the magazine 37 on their way toward the magazine 9. The surplus removing device 39 performs a combing action in that it comprises a plurality of blades or paddles 46 each of which resembles a comb and serves to equalize the batch which is carried by the adjacent comb-like vane 12 so that the quantity of short tobacco which a pocket P is allowed to carry toward the magazine 9 is not in excess of a predetermined value. The illustrated device 39 is a paddle wheel which rotates its paddles 46 in a counterclockwise direction, as viewed in FIG. 1, i.e., counter to the direction of travel of the ascending reach 13*b* of the belt 13*a*. The direction of rotation of the paddle wheel 39 is indicated by the arrow 41, and the direction of travel of the ascending reach 13*b* is indicated by the arrow 42. The polygonal shaft or core 44 of the paddle wheel 39 carries four comb-like blades 46 each of which is serrated (see particularly FIG. 2) and the trapeziform spaces or gaps 47 between the teeth or prongs 46*a* of the blades 46 are wide and deep enough to allow, with clearance, for the passage of narrow and slender triangular prongs or projections 12*a* of the vanes 12 on the belt 13*a*. The end portions of the shaft 44 are rotatable in antifriction bearings 48 and 49 which are installed in the frame members 51 and 52 of the housing H. The shaft 44 is driven independently of the elevator conveyor 13 by a discrete prime mover 56 (e.g., a suitable electric motor) through the medium of a gear transmission 53, 54. The prongs 46*a* of the blades 46 on the shaft 44 are preferably trapezoidal, and the depth of the spaces 47 between the prongs 46*a* is such that the tips of the triangular projections 12*a* (which alternate with the trapezoidal prongs 46*a*) penetrate approximately midway into the respective spaces 47 when the shaft 44 is rotated and the reach 13*b* of the belt or band 13*a* moves upwardly, as viewed in FIG. 1.

If the operator wishes to change the quantity of short tobacco which is entrained by successive vanes 12 of the belt or band 13*a*, the positions of the blades 46 with respect to the shaft 44 are adjusted so that the triangular projections 12*a* penetrate deeper or to a lesser extent into the spaces 47. This can be achieved by shifting the blades 46 radially of the shaft 44. To this end, each blade 46 has two or more elongated slots 57 for screws, bolts or analogous fasteners 58 which extend into tapped bores of the shaft 44 and can be loosened to allow for rapid adjustment of the blades.

An important advantage of the improved distributor is that the batches of short tobacco which are removed by successive vanes 12 during travel past the magazine 37 are equalized by the removing device or paddle wheel 39 before the respective pockets P reach the magazine 9, i.e., before the pockets P are filled (preferably overfilled) with fresh tobacco of the supply 8. Since the surplus of fresh tobacco is removed by the equalizing device 14, the distributor 2 equalizes both types of tobacco so that each augmented batch which reaches the upper end turn 13*c* of the elevator 13 and is transferred (by gravity) into the duct 16 contains a predetermined quantity of short tobacco as well as a predetermined quantity of fresh tobacco.

The surplus removing paddle wheel 39 ensures that the pockets P cannot be unduly filled with short tobacco, i.e., that each pocket P is capable of accepting a certain quantity of fresh tobacco (of the second type) so that the augmented batches which are dumped into the duct 16 invariably contain desired quantities of a plurality of different tobacco types.

The positions of the blades 46 relative to the shaft 44 of the surplus removing paddle wheel 39 can be readily selected in such a way that each pocket P accepts and retains a relatively small quantity of short tobacco. Moreover, the quantity of short tobacco does not change from pocket to pocket but remains constant as long as the operator desires, i.e., until and unless the operator decides to change the positions of the blades 46 with respect to the shaft 44. The selected adjustment of the blades 46 is preferably such that the quantity of tobacco which is stored in the magazine 37 for short tobacco is at least substantially constant, i.e., that the paddles 12 remove short tobacco at the same rate at which such tobacco is formed by the trimming device below the conveyor 33 and at which the conveyor 38 delivers short tobacco into the magazine 37.

The provision of cooperating projections or prongs 46*a* and 12*a* on the blades 46 and vanes 12 further ensures that the particles of short tobacco are uniformly distributed as considered in the longitudinal direction of the pockets P (i.e., at right angles to the plane of FIG. 1). Each prong 12*a* retains a certain relatively small quantity of short tobacco, and the thus obtained batch is then augmented and covered by fresh tobacco which is withdrawn (by a combing action) from the magazine 9 while the prongs 12*a* travel upwardly along the supply 8 of fresh tobacco.

The surplus removing paddle wheel 39 can be replaced with other types of surplus removing means without departing from the spirit of the invention. This paddle wheel need not deviate from conventional paddle wheels which are used in many types of distributors to remove the surplus of tobacco from the mass which is withdrawn from a supply of fresh tobacco. However, in contrast to paddle wheels which are used in conventional distributors, the paddle wheel 39 equalizes short tobacco before such tobacco is mixed with or augmented by fresh tobacco (in the magazine 9). This renders it possible to ensure that each augmented batch of tobacco which advances beyond the equalizing paddle wheel 14 for fresh tobacco contains a predetermined quantity of short tobacco as well as a predetermined quantity of fresh tobacco. At the very least, the quantity of short tobacco in the pockets P does not exceed a preselected maximum value, and the quantity of fresh tobacco also does not exceed a preselected maximum value because such quantity is limited by the paddle wheel 14.

Another important advantage of the illustrated paddle wheel 39 for removal of the surplus of short tobacco is that it enables the tips of the projections 12*a* to remove fresh tobacco from the supply 8 by a combing action because such tips are exposed as a result of rotation of the blades 46 relative to the oncoming vanes 12 of the belt or band 13*a*. Furthermore, and as already explained above, the illustrated paddle wheel 39 renders it possible to effect uniform or nearly uniform distribution of short and fresh tobacco along the full length of each pocket P. This contributes to more satisfactory homogeneousness of tobacco in the duct 16 and to a more satisfactory classifying action of the unit 26.

In the illustrated embodiment, the paddle wheel 39 is located at a level below the bottom wall 36 of the magazine 9 so that the removed surplus of short tobacco returns into the magazine 37. However, it is equally within the purview of the invention to accumulate short tobacco which is removed from the pockets P by the blades 46 and to return the thus accumulated short tobacco to the magazine 37 by resorting to a separate conveyor, not shown. The illustrated construction is preferred because it is simpler and enhances the compactness of the distributor 2.

Experiments with the improved distributor prove that the equalization of batches of short tobacco is highly satisfactory and also that short tobacco which is removed by the projections 46*a* of the blades 46 is not subjected to a pronounced comminuting action, i.e., that the paddle wheel 39 does not act as a trimming device but rather solely or almost exclusively as a combing means for removing particles without any comminution. The use of projections in the form of slender triangles 12*a* on the vanes 12 contributes to a reduction of likelihood of comminution of short tobacco which has been withdrawn from the supply in the magazine 37 and travels past the rotating paddle wheel 39.

As a rule, the quantity of fresh tobacco which is removed from the magazine 9 greatly exceeds the quantity of short tobacco which is withdrawn from the magazine 37. In other words, the percentage of fresh tobacco in the pile 17 which partially fills the duct 16 is much greater than the percentage of short tobacco.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above described contribution to the art and, therefore, such adaptations should and are intended to be comprehended within the meaning and range of equivalence of the appended claims.

What is claimed is:

1. In a method of forming a tobacco stream which contains predetermined percentages of plural types of tobacco, the steps of establishing and maintaining discrete first and second sources of first and second tobacco types; withdrawing from the first source a succession of discrete batches at least some of which contain a surplus of tobacco of the first type; removing the surplus from the respective batches so that, upon completion of said removing step, each of said batches at most contains a predetermined maximum quantity of tobacco of the first type; transporting successive batches past said second source; augmenting successive batches including adding to such batches tobacco of the second type during transport past said second source; and converting the augmented batches into said stream.

2. The steps of claim 1, wherein said removing step includes segregating the surplus from successive batches which contain a surplus of tobacco of the first type by a combing action.

3. The steps of claim 1, wherein said augmenting step includes adding a surplus of tobacco of the second type to at least some of said batches, and further comprising the step of equalizing the augmented batches prior to said converting step including segregating the surplus tobacco of the second type from the respective augmented batches.

4. The steps of claim 3, further comprising the steps of establishing an elongated path which extends past and beyond said sources and advancing a plurality of equidistant pockets along said path, said step of withdrawing discrete batches including at least partially filling the pockets during advancement of the pockets past said first source, said removing step including expelling tobacco of the first type from successive pockets in a portion of said path between said first and second sources, said augmenting step including overfilling successive pockets during advancement of the pockets past said second source, and said segregating step including removing from successive pockets any tobacco of the second type which extends from the overfilled pockets.

5. The steps of claim 4, wherein said path slopes upwardly in a direction from the first source toward and beyond the second source.

6. The steps of claim 4, further comprising the step of maintaining the quantity of tobacco in at least one of said sources at a substantially constant value.

7. The steps of claim 1, wherein at least the major part of tobacco of said first type consists of short tobacco and at least the major part of tobacco of said second type consists of tobacco shreds.

8. The steps of claim 1, further comprising the steps of equalizing the stream including trimming therefrom at least some particles of tobacco and transporting the trimmed off tobacco to said first source.

9. The steps of claim 1, wherein each of said withdrawing and augmenting steps includes combing tobacco in the respective sources to respectively remove batches from the first source and add tobacco of the second type to successive batches.

10. The steps of claim 1, further comprising the step of introducing the removed surplus of tobacco of the first type into said first source.

11. The steps of claim 1, further comprising the step of changing the ratio of tobacco of the first and second types in the tobacco stream.

12. In an apparatus for forming a tobacco stream which contains predetermined percentages of plural types of tobacco, the combination of a first source containing tobacco of a first type; a second source containing tobacco of a second type; conveyor means having a plurality of entraining elements defining a series of pockets; means for moving said elements along a predetermined path wherein said elements advance first past said first source to remove therefrom batches of tobacco of the first type, whereby at least some batches contain a surplus of first tobacco, and thereupon past said second source to augment the batches by adding thereto tobacco of the second type; means for removing the surplus of tobacco of the first type from the respective batches intermediate said first and second sources so that each of the batches advancing past said second source at most contains a predetermined maximum quantity of tobacco of the first type; and means for converting the augmented batches into said stream.

13. The combination of claim 12, further comprising means for trimming the stream, including means for segregating from the stream tobacco of the first type, and means for delivering segregated tobacco of the first type to said first source.

14. The combination of claim 12, wherein said removing means includes at least one mobile comb arranged to remove the surplus from successive surplus-containing batches ahead of said second source.

15. The combination of claim 14, wherein each of said entraining elements includes a plurality of prongs which comb the supplies of tobacco in said sources to thereby respectively remove batches from said first source and augment the batches by removing tobacco from said second source.

16. The combination of claim 15, wherein said removing means includes a rotary paddle wheel and said comb constitutes a paddle of said wheel, said paddle having a plurality of projections alternating with the prongs of successive entraining elements while said wheel rotates and said elements advance past said wheel intermediate said first and second sources.

17. The combination of claim 16, further comprising means for rotating said paddle wheel counter to the direction of advancement of said elements.

18. The combination of claim 16, wherein said projections define a plurality of spaces and said prongs have tips passing with clearance through the spaces between said projections.

19. The combination of claim 18, wherein said prongs are slender triangles.

20. The combination of claim 19, wherein said spaces have a trapezoidal outline.

21. The combination of claim 12, further comprising means for equalizing at least some of the augmented batches.

22. The combination of claim 12, wherein said first source contains short tobacco.

23. The combination of claim 12, further comprising means for maintaining the supply of tobacco in at least one of said sources at a substantially constant value.

* * * * *